US006654963B2

(12) United States Patent
Fayle et al.

(10) Patent No.: US 6,654,963 B2
(45) Date of Patent: Dec. 2, 2003

(54) OUTDOOR JACKET

(75) Inventors: Thomas Walker Clarke Fayle, North Vancouver (CA); Thomas R. Routh, Vancouver (CA)

(73) Assignee: Arc'Teryx Equipment, Inc., Burnaby ( * ) Notice: Subject to any disclaimer, the term of this patent is extended or adjusted under 35 U.S.C. 154(b) by 0 days.

(21) Appl. No.: 09/903,344

(22) Filed: Jul. 10, 2001

(65) Prior Publication Data

US 2002/0095712 A1 Jul. 25, 2002

(30) Foreign Application Priority Data

Jan. 24, 2001 (CA) ..... 2001-0167
Jan. 24, 2001 (CA) ..... 2332201

(51) Int. Cl.[7] ..... A41D 3/00
(52) U.S. Cl. ..... 2/84
(58) Field of Search ..... 2/84, 85, 86, 87, 2/88, 93, 94, 202, 203, 204, 205; D2/825, 831

(56) References Cited

U.S. PATENT DOCUMENTS

| | | | | |
|---|---|---|---|---|
| 690,982 A | | 1/1902 | Morse | |
| 727,793 A | | 5/1903 | Higgins | |
| 2,567,192 A | | 8/1951 | De Grazia | 2/205 |
| 2,581,366 A | | 1/1952 | De Grazia | 2/203 |
| 4,334,325 A | | 6/1982 | Walkuski | 2/202 |
| 4,354,496 A | * | 10/1982 | Andersen | 128/403 |
| 4,453,292 A | | 6/1984 | Bakker | 24/115 |
| 4,606,078 A | * | 8/1986 | Tkacsik | 2/84 |
| 5,048,128 A | | 9/1991 | Watson, Jr. | 2/204 |
| 5,119,510 A | * | 6/1992 | Schilling | 2/4 |
| 5,263,202 A | | 11/1993 | Siberell | 2/336 |
| 5,369,809 A | | 12/1994 | Hall | 2/202 |
| 5,765,230 A | * | 6/1998 | Sivret et al. | 2/202 |
| 5,832,538 A | * | 11/1998 | Williams | 2/202 |
| 5,953,757 A | | 9/1999 | Blanks, I | 2/243.1 |
| 5,960,478 A | * | 10/1999 | Sivret et al. | 2/202 |
| 6,023,787 A | | 2/2000 | French et al. | 2/202 |
| 6,088,838 A | | 7/2000 | Sontag | 2/202 |
| 6,260,207 B1 | * | 7/2001 | Barbeau et al. | 2/202 |
| 6,370,692 B1 | * | 4/2002 | Duyn et al. | 2/86 |
| 6,374,418 B1 | | 4/2002 | Rindle | 2/202 |
| 6,442,763 B1 | * | 9/2002 | Larson et al. | 2/202 |

FOREIGN PATENT DOCUMENTS

| | | |
|---|---|---|
| DE | 4241731 A1 | 10/1992 |
| DE | 20118164 U1 | 8/2001 |
| EP | 0673609 A1 | 3/1995 |
| JP | 07252712 | 3/1995 |
| JP | 2001020126 | 1/2001 |
| JP | 2002004125 | 9/2002 |

* cited by examiner

*Primary Examiner*—John J. Calvert
*Assistant Examiner*—Alissa L. Hoey
(74) *Attorney, Agent, or Firm*—Bret E. Field; Bozicevic, Field & Francis

(57) ABSTRACT

In one aspect, the invention provides a hood drawstring arrangement that may be adapted to allow a single adjustment to exert tension along the vertical sides of the front face opening of the hood, which will tend to vertically compress the hood, as well as simultaneously exerting a circumferential tensioning of the top portion of the hood.

6 Claims, 10 Drawing Sheets

OUTDOOR JACKET

CROSS REFERENCE TO RELATED APPLICATIONS

This application claims priority to Canadian Patent Application No. 2,332,201, filed on Jan. 24, 2001, and to Canadian Industrial Design Application No. 2001-0167, filed Jan. 24, 2001; the disclosures of which are herein incorporated by reference.

FIELD OF THE INVENTION

The invention is in the field of garments, particularly outdoor garments.

BACKGROUND OF THE INVENTION

Jackets often have hoods, to provide a covering for the top the head while leaving an opening for the face. A wide variety of inventive hood adjustment mechanisms are known, as for example are disclosed in U.S. Pat. Nos. 6,088,838; 6,023,787; 5,369,809; 4,334,325; 2,581,366; and, 2,567,192. Multiple drawstrings have for example often been used to provide vertical and horizontal adjustments on jacket hoods. In many cases, one drawstring on each side of the hood affords vertical adjustment on either side of the face opening, along the temporal portions of the hood. There may also be a rear drawstring which affords adjustment of the position of the brim by lengthening or shortening the arc of the hood along the mid-line from the shoulders to the forehead. In some cases, a drawstring may also be provided to tension the hood circumferentially against the top portion of the skull (the cranium), in a manner analogous to a hat band adjustment. There remains a need for alternative mechanisms of adjusting the fit of a hooded garment to a wearer's head.

Many outdoor jackets include relatively high collars, which may reach up above the chin of a person wearing the jacket. As a result, the slide fastener, such as a zipper, which typically runs up the front midline of the jacket may be brought into uncomfortable contact with the person's chin or lips. This may be particularly problematic in weather that is sufficiently cold to make skin contact with a metal zipper slider potentially harmful.

SUMMARY OF THE INVENTION

In one aspect, the invention provides a hood drawstring arrangement that may be adapted to allow a single adjustment to exert tension along the vertical sides of the front face opening of the hood, which will tend to vertically compress the hood, as well as simultaneously exerting a circumferential tensioning of the top portion of the hood, which will tend to contract the hood across the forehead and around the back of the wearer's head (tensioning the cranial portion of the hood). The drawstring arrangement may be adapted to exert these tensioning forces while leaving the brim of the hood free to protrude above the face opening.

In one aspect, the invention provides a hood having a head covering and a face opening. The hood may include an adjustable drawstring arrangement providing for simultaneous circumferential tensioning of the head covering and vertical temporal tensioning of the face opening. The drawstring arrangement may include one or more cranial cord segments encircling the head covering, connected to left and right temporal cord segments on each lateral side of the face opening. The cord segments may co-operate so that manual tensioning of the cranial cord segment(s) acts to tension the temporal cord segments; or, manual tensioning of either the left or right temporal cord segment acts to tension the cranial cord segment(s). The cranial cord segments may be generally horizontal, and the temporal cord segments may be generally vertical. The cord segments may be elasticated, and may form a drawstring that runs in channels or passageways formed in the hood material. The hood may include a brim that has an inner cranial cord segment flexibly connected to an outer brim reinforcing member, so that the inner cord segment can assist in securing the hood to the wearer's head while the brim reinforcing member helps to preserve the shape of the brim.

In an alternative aspect, the invention provides a jacket adapted to cover a person's chest and having a collar adapted to cover a persons neck, in which a front opening of the jacket is closable with a curved slide fastener, such as a zipper. The slide fastener may be disposed vertically along the anterior midline of the jacket over the chest, and then curve laterally so that the slide fastener is offset from the anterior midline of the collar. This arrangement may avoid positioning the slider of the slide fastener over the wearer's mouth when the fastener is in a closed position with the slider at the top of the fastener. In some embodiments, the curved slide fastener may be coated with a resilient polymeric compound such as a thermoplastic polymer, which may assist in achieving the curved conformation of the fastener. The polymeric coating may help to make the slide fastener water resistant.

DETAILED DESCRIPTION OF THE INVENTION

Figure 1:
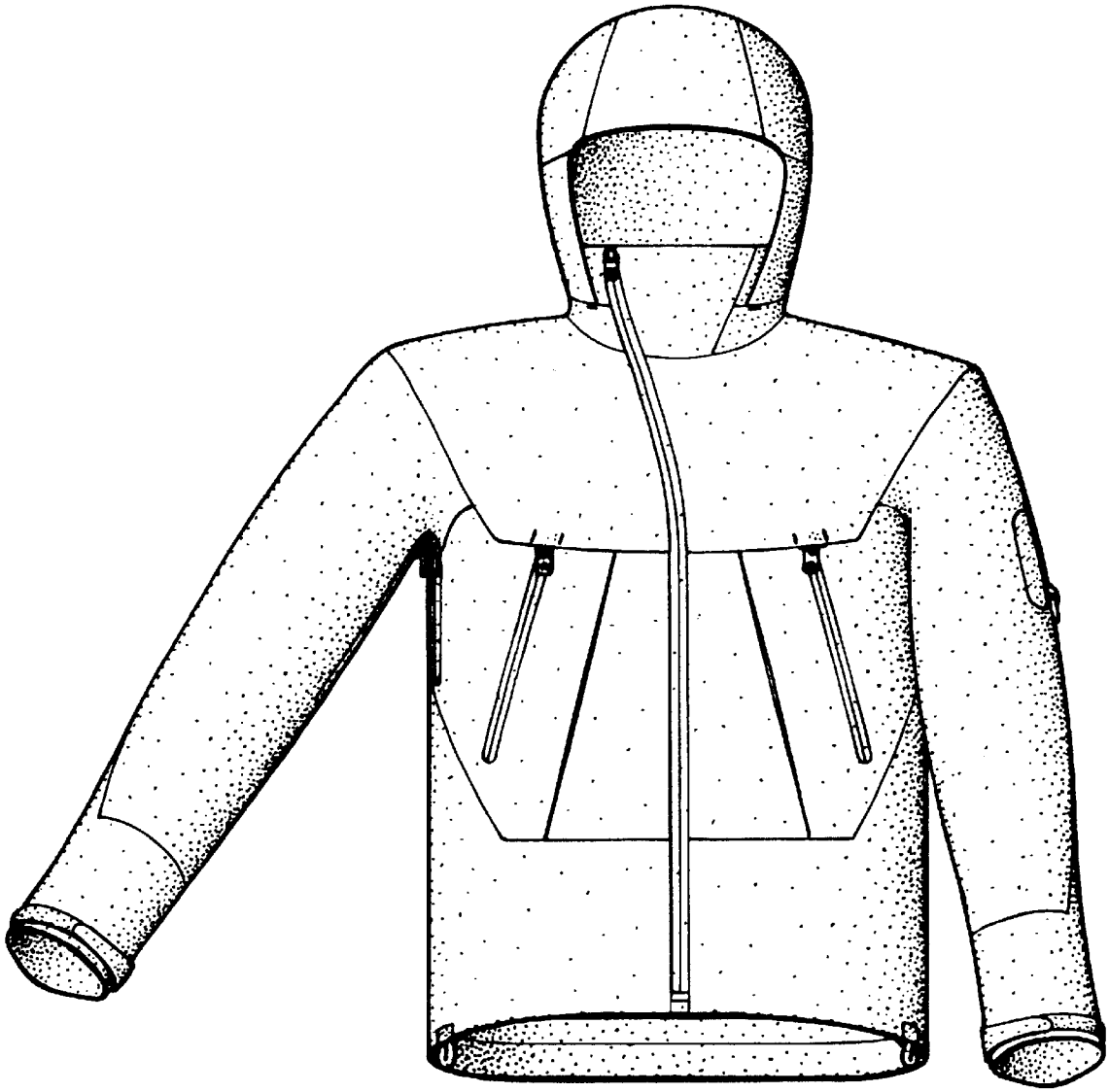
FIG. 1 is a front view of a jacket of the invention, with stippling to show the overall shape, configuration and design of the jacket, illustrating the curved slide fastener on the front opening of the jacket and the absence of draw strings around the face opening of the hood.
Figure 2:
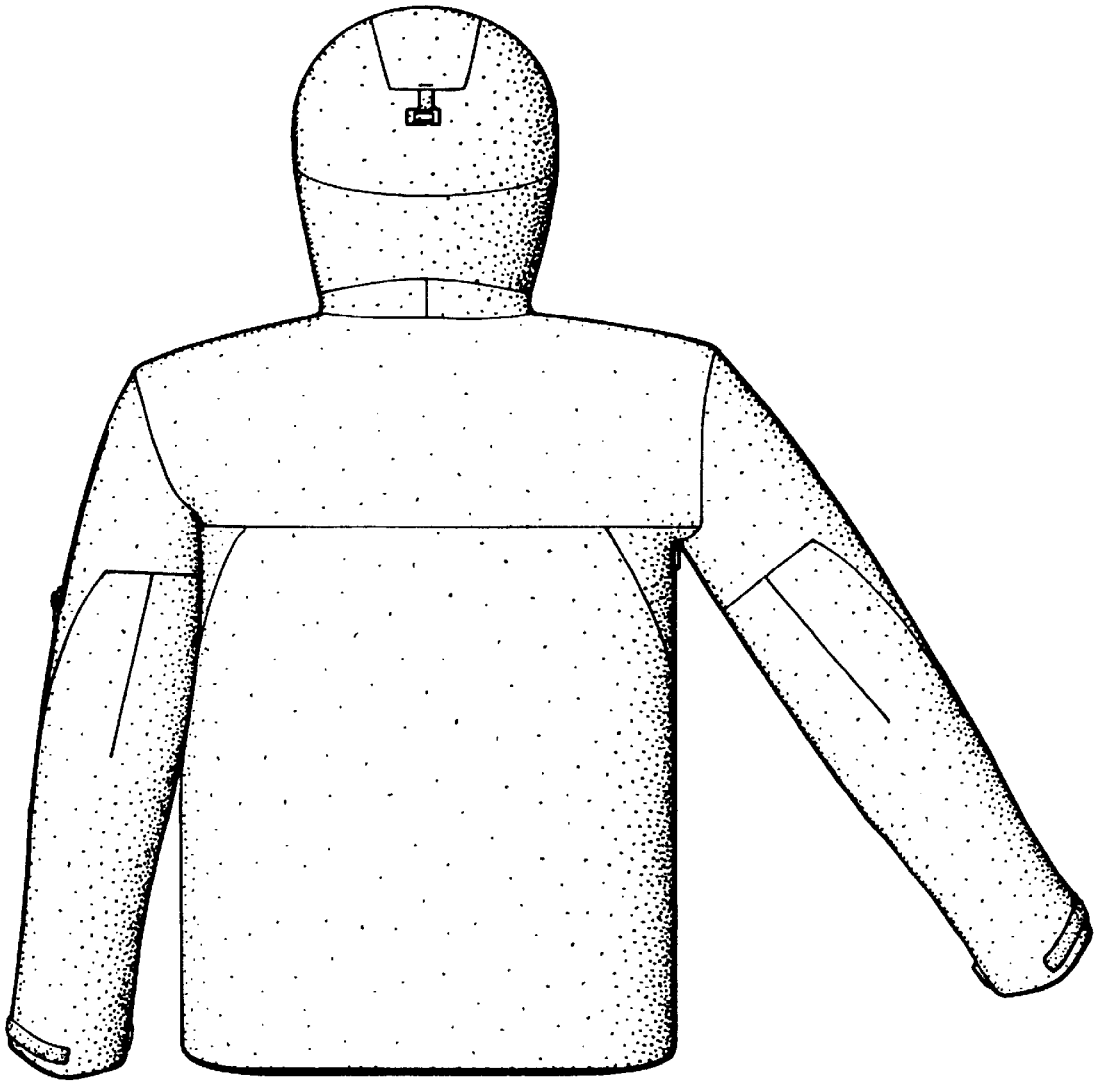
FIG. 2 is a rear view of a jacket of the invention, with stippling to show the overall shape, configuration and design of the jacket, illustrating the drawstring and cord lock at the rear of the hood.
Figure 3:
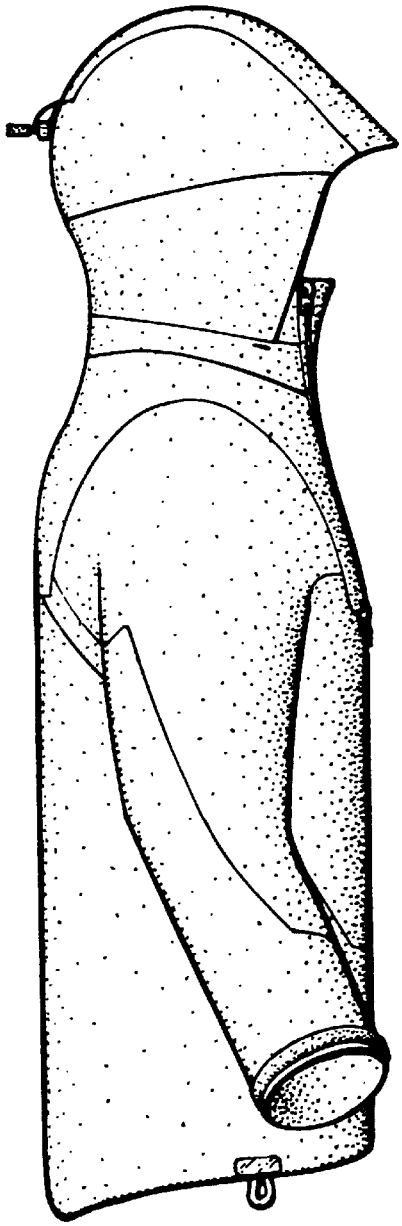
FIG. 3 is a right side view of a jacket of the invention, with stippling to show the overall shape, configuration and design of the jacket, illustrating the curvature of the right arm, the elongated rear hem, and the protruding brim of the hood.
Figure 4:
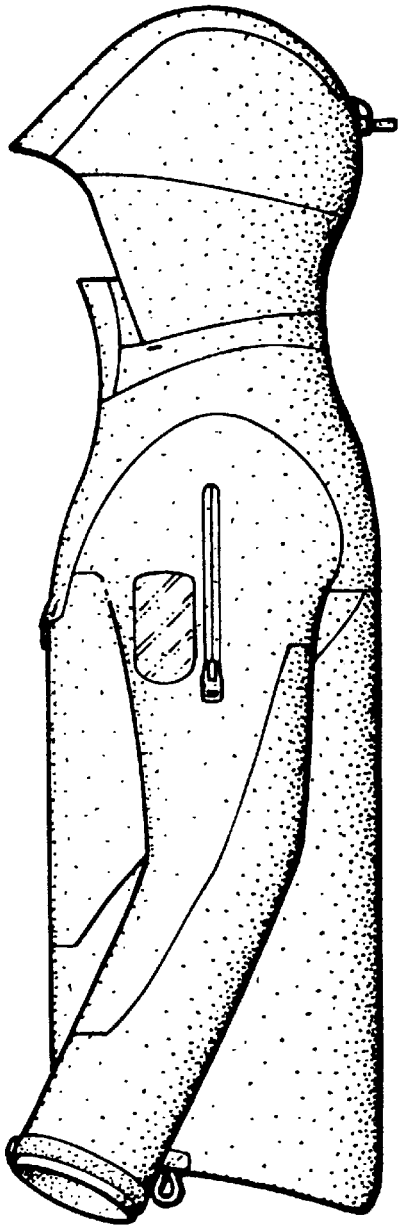
FIG. 4 is a left side view of a jacket, with stippling to show the overall shape, configuration and design of the jacket, illustrating the curvature of the left arm, the left should pocket with window and adjacent slide fastener, the elongated rear hem, and the protruding brim of the hood.
Figure 5:
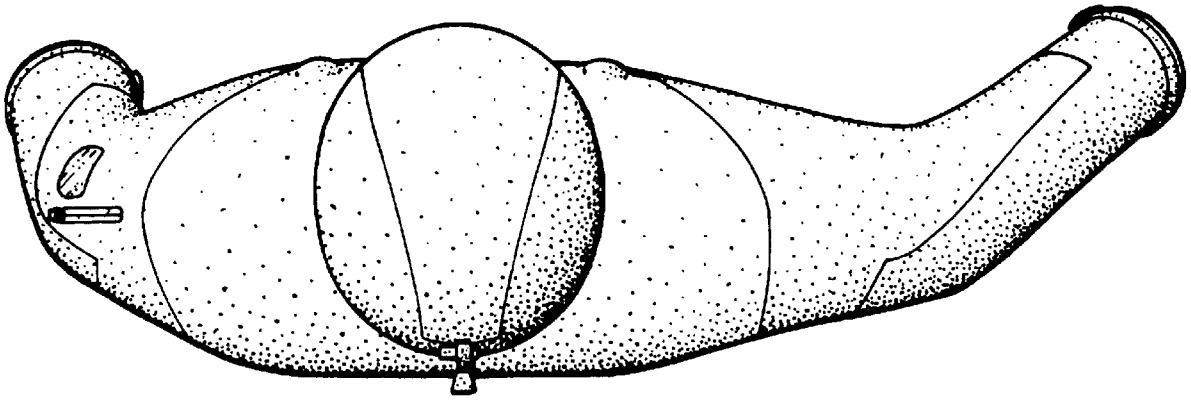
FIG. 5 is a top view of a jacket, with stippling to show the overall shape, configuration and design of the jacket, illustrating the drawstring and cord lock at the rear of the hood and the windowed left shoulder pocket.
Figure 6:
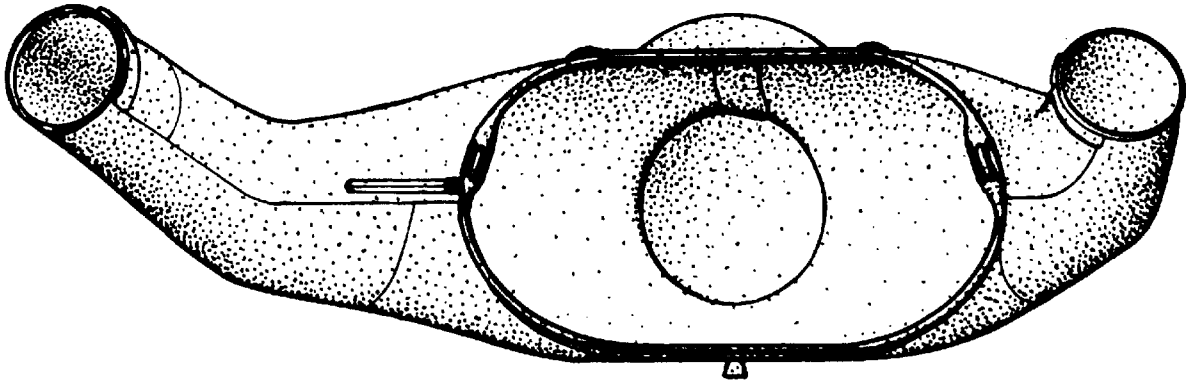
FIG. 6 is a bottom view of a jacket, with stippling to show the overall shape, configuration and design of the jacket, illustrating the armpit slide fasteners on the underside of the arms.
Figure 7:
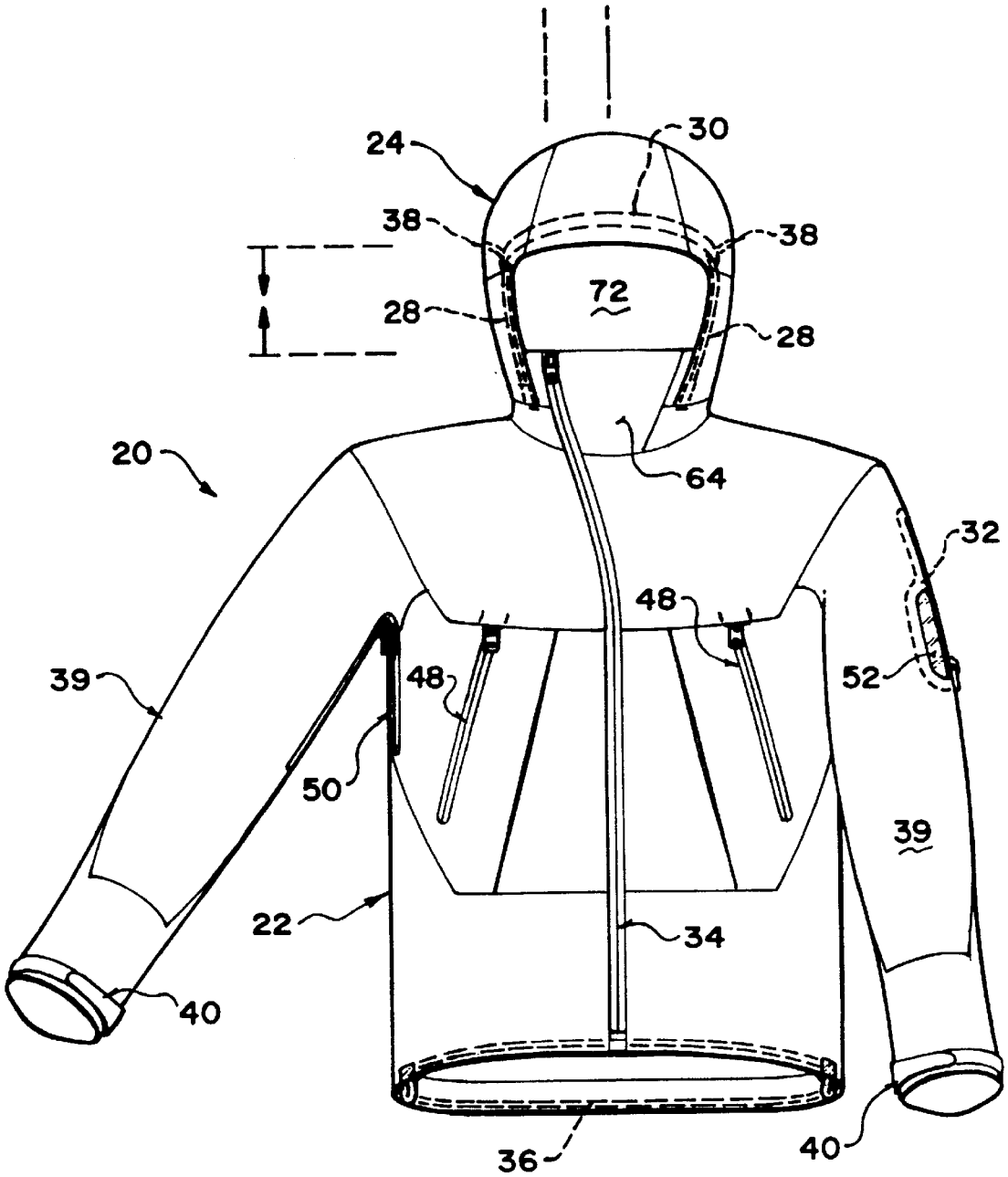
FIG. 7 is a front view of a jacket of the invention with dashed lines illustrating the drawstring passageways around the face opening and the internal boundary of the left shoulder pocket.
Figure 8:
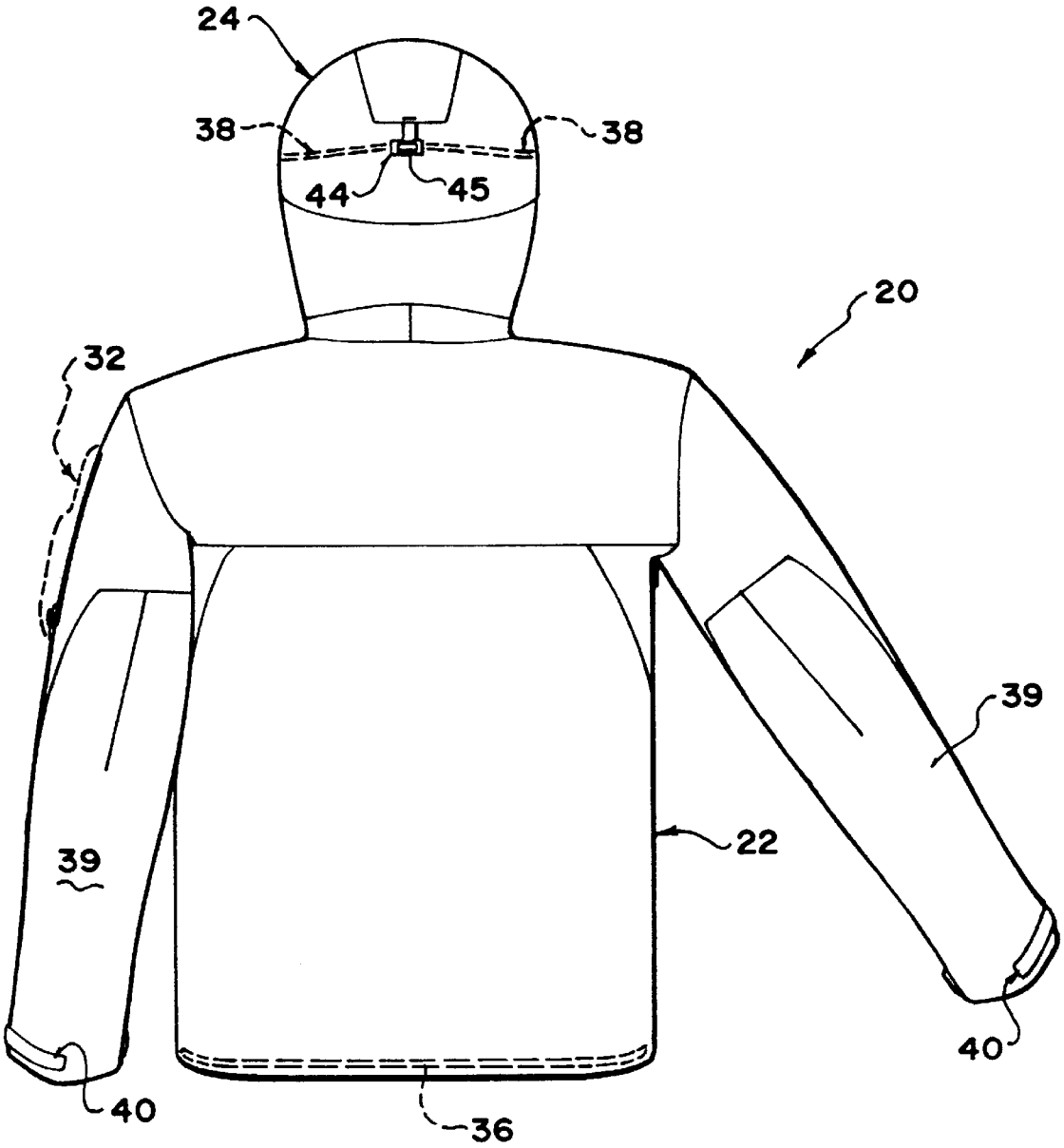
FIG. 8 is a rear view of a jacket of the invention with dashed lines illustrating the circumferential cranial drawstring passageways in the hood, the drawstring passageway in the hem, and the extent of the expanded left should pocket.
Figure 9:
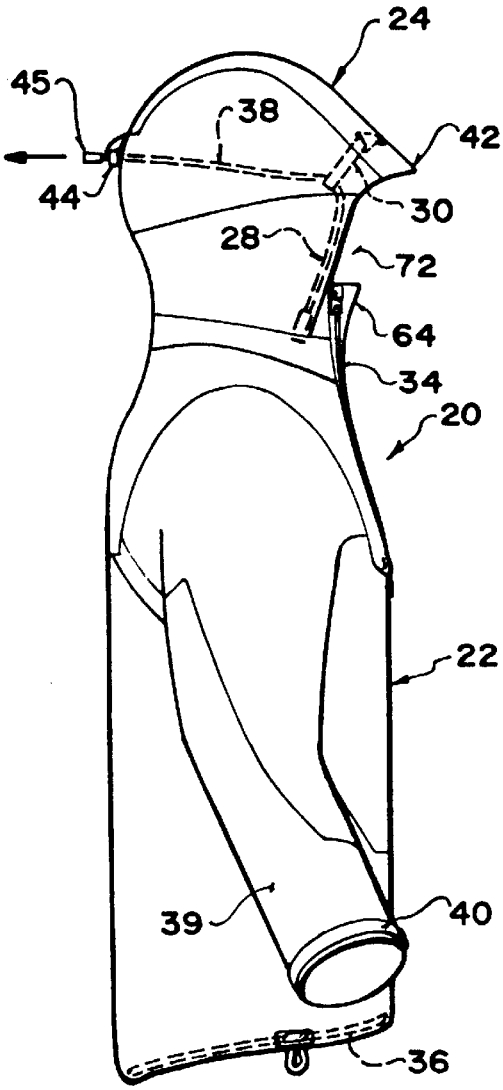
FIG. 9 is a right side view of a jacket of the invention with dashed lines illustrating the drawstring cord passageway from the rear of the hood, along the right side of the hood and then down along the right edge of the face opening, with an arrow showing the direction of hood drawstring tensioning movement.
Figure 10:
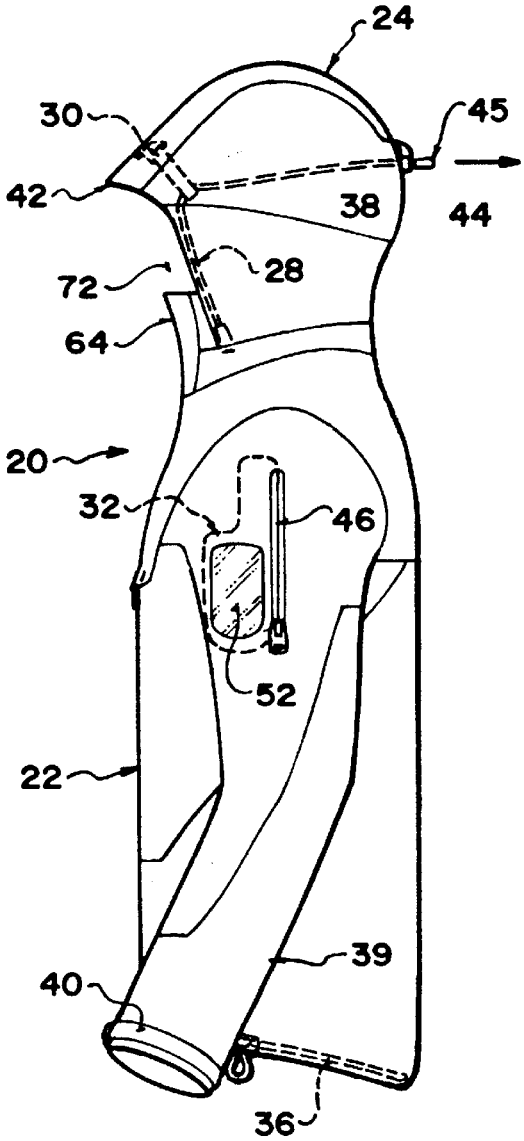
FIG. 10 is a left side view of a jacket of the invention with dashed lines illustrating the drawstring cord passageway from the rear of the hood, along the left side of the hood and then down along the left edge of the face opening, with an arrow showing the direction of hood drawstring tensioning movement, and with dashed lines showing the internal outline of the left shoulder pocket.
Figure 11:
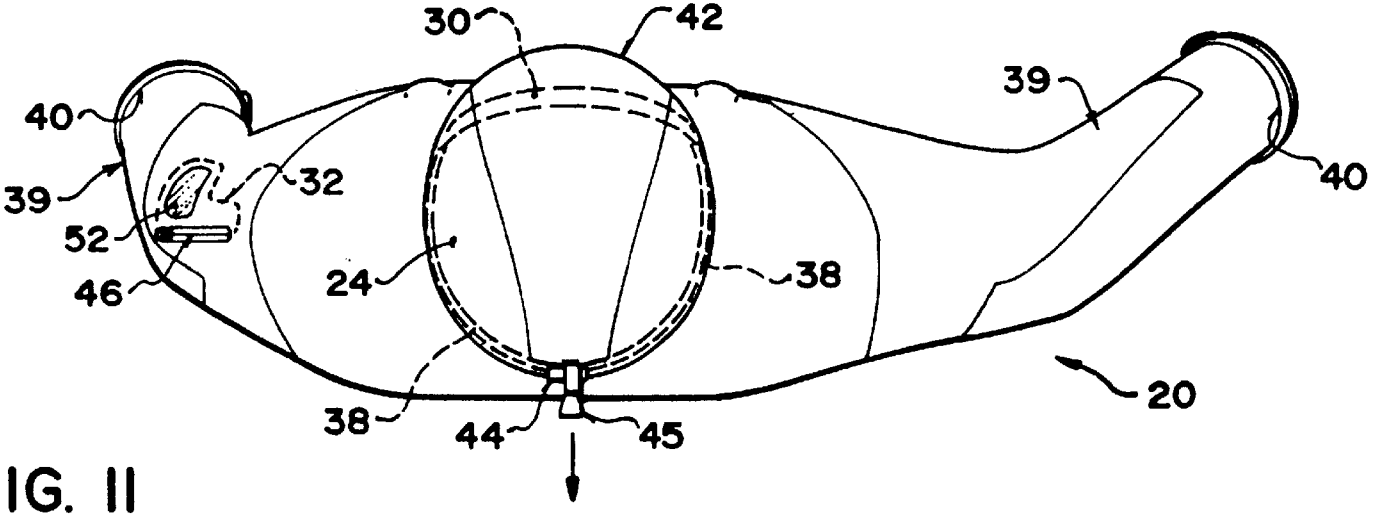
FIG. 11 is a top view of a jacket, illustrating the hood drawstring passageways in dashed outline.
Figure 12:
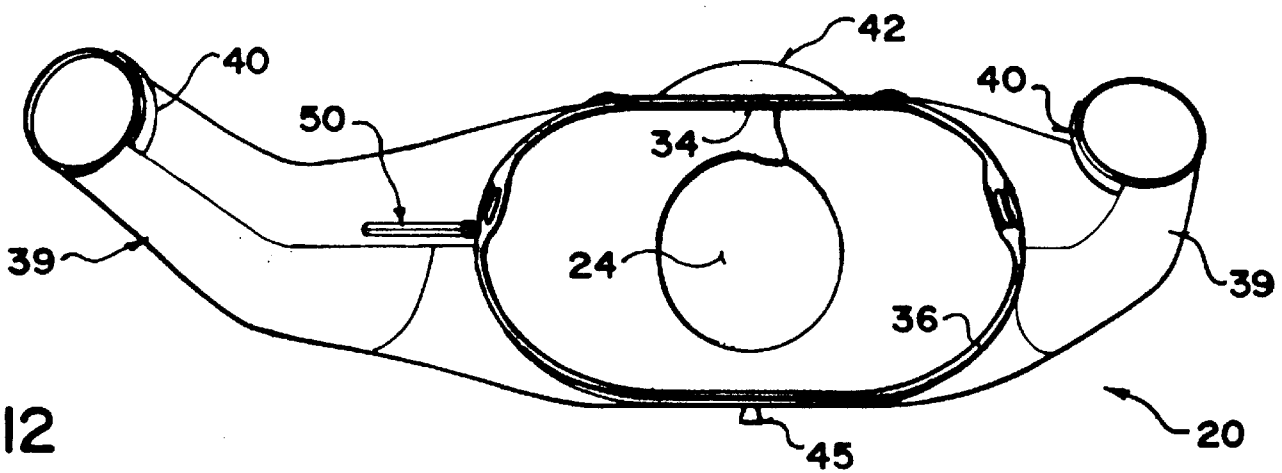
FIG. 12 is a bottom view of a jacket illustrating the hem drawstring passageway the hem cord lock.
Figure 13:
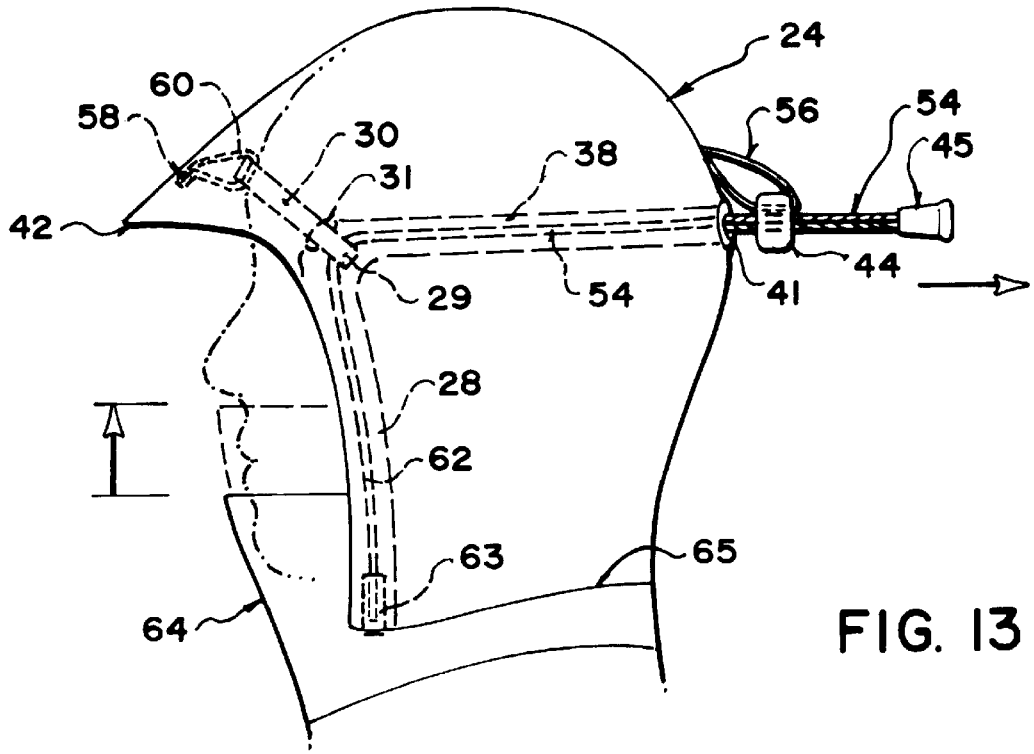
FIG. 13 is a left side view of the hood, showing the drawstring passageways, with an arrow in front showing the notional vertical tensioning force that may be applied by manipulation of the drawstring at the rear of the hood in the direction of the arrow shown at the rear of the hood.
Figure 14:
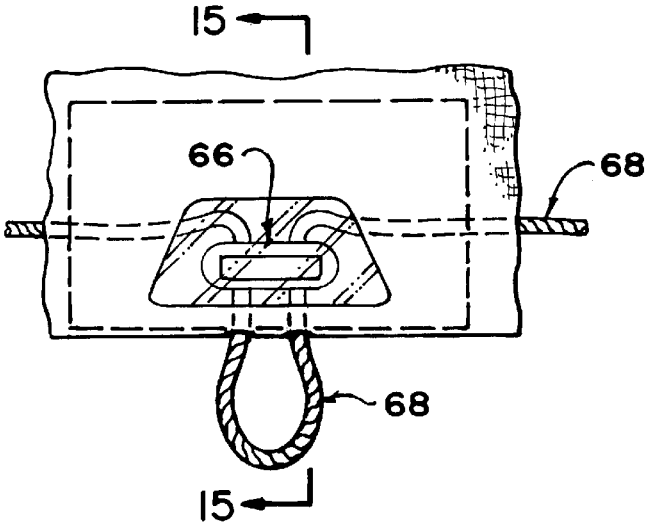
FIG. 14 is a side view of the hem drawstring cord lock, showing the loop formed by the hem drawstring.
Figure 15:
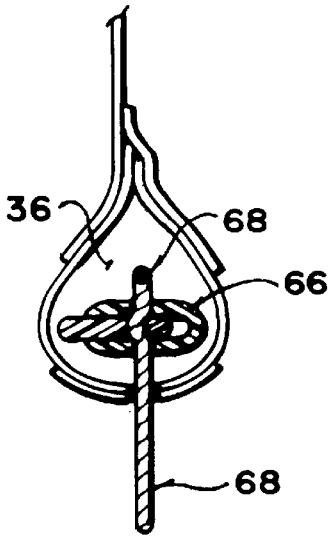
FIG. 15 is a cross-sectional view of the hem drawstring cord lock.

FIGS. 1 through 6 illustrate the overall shape, configuration and design of jacket 20, having hood 24 attached to upper body portion 22 which may include collar 64. Underarm slide fasteners 50 may be provided for ventilation, and breast pocket slide fasteners 48 may provide access to pocket storage space in the front of jacket 20. Sleeves 39 may be provided with surface fasteners 40, such as VELCRO (™) brand fasteners, at the cuffs. A front slide fastener 34 may provide an opening on the front of the jacket, which may be curved. Collar 64 and hood 24 together define face opening 72.

Jacket 20 may be made out of a wide range of materials, such as natural fibres and/or synthetic materials. In some embodiments, the jacket may be made of a waterproof breathable laminate such as expanded porous polytetrafluoroethylene coated with a breathable fabric, as is well known in the art of technical outdoor garments.

The adjustable drawstring arrangement of hood 24 may include one or more cranial cord segments adapted to be positionable to encircle the cranial portion of a wearer's head. As shown in FIGS. 8, 9, 10 and 13, a rear cranial cord segment 54 may run along each side of hood 24 from rear draw string cord lock 44, into rear hood opening 41 and through internal rear drawstring passageway 38 to an interconnection with a front cranial cord segment 30. Cord locks may for example be constructed as disclosed in U.S. Pat. No. 4,453,292 (incorporated herein by reference) or in accordance with the wide variety of alternative cord locks known in the outdoor garment art. As illustrated, front cranial cord segment 30 may run through a passageway defined by flexible brim connector 60, shown in FIG. 13, and pass through side openings 31 into the internal hood cord passageway 38, 28 (through which run drawstring cord segments 54 and 62 respectively, which are unitary segments in the illustrated embodiment).

In the illustrated embodiment, front cranial cord segment 30 forms loop 29 after passing through side openings 31, and unitary drawstring 54, 62 passes through loop 29 to form the connection between drawstring 54, 62 and front cranial cord segment 30. As alternatives to loop 29, other means may be provided for connecting draw string segments, such as stitches and glue. A brim stiffening member 58 may be flexibly connected to front cranial cord segment 30, to help stiffen and shape brim 42. In this arrangement, front cranial cord segment 30 may be tightened against a persons head without unduly flattening brim 42. Manual tensioning by pulling on drawstring 54, 62 at toggle 45 in the direction of the arrow shown in FIG. 13 acts to tighten the circumferential cranial cord segments, 54 and 30, as well as tensioning temporal cord segments 62. Similarly, in an embodiment that is not illustrated, cord segments may be arranged so that manual tensioning of either a left or right temporal cord segment 62 may act to tension the circumferential cranial cord segments 30, 54. In this way, the adjustable hood drawstring arrangement of the invention provides a variety of embodiments adapted for simultaneous circumferential tensioning of the cranial covering portion of hood 24 as well as vertical temporal tensioning of hood 24 along the lateral margins of face opening 72. In some embodiments, cranial cord segments 30, 54 may be generally horizontal and temporal cord segments 62 may be generally vertical.

It will be seen that cord arrangements other than the illustrated embodiment may be adapted to provide the desired result. For example, toggle 45 and cord lock 44 need not be located at the rear of hood 24. Alternative embodiments may have a toggle and cord lock arranged, for example, near the collar at the bottom end of one or both of the vertical channels 28. More than one toggle and cord lock may be provided for manual operation of the one or more interconnected cord segments. In the illustrated embodiment, the base of each temporal cord segment 62 is anchored (for example by adhesive or by stitching) in passageway 28 at a location 63 that is near the junction 65 between hood 24 and collar 64.

In various aspects of the invention, drawstrings may be elasticated cords, and the drawstrings may run in channels or passageways formed in the hood material, formed for example by adhesive application of channel strips to the interior of the hood, or by sewn channels or guides applied to the inside of hood 24.

Figure 16A:
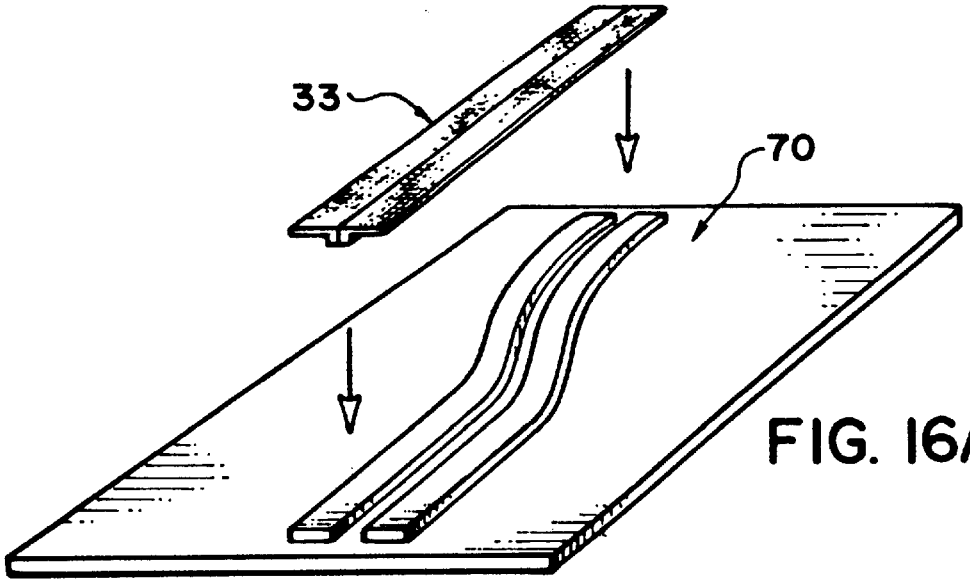
FIGS. 16A, 16B and 16C show sequential steps in a method of the invention for making a curved slide fastener.
Figure 16B:
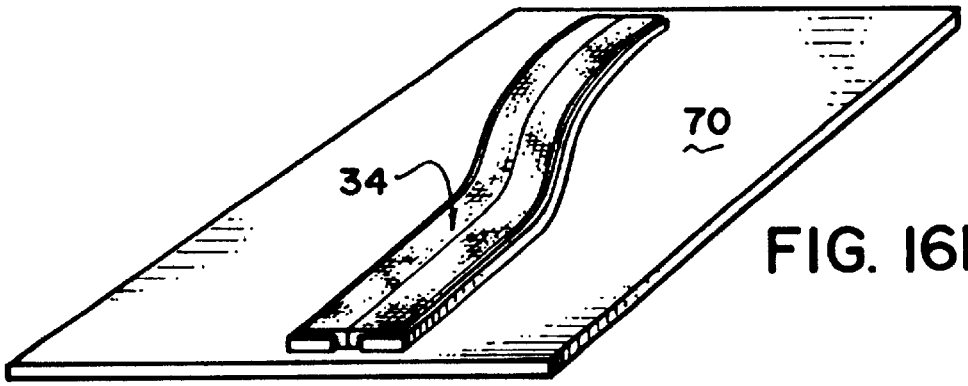
Figure 16C:
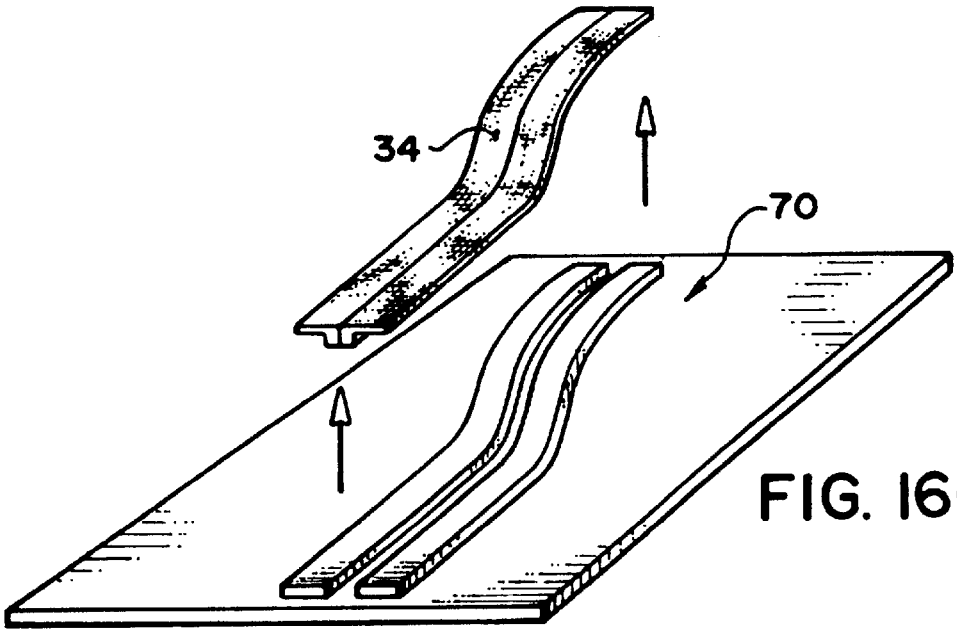

In alternative aspects, the invention provides methods of producing a curved slide fastener, such as a zipper. As shown in FIG. 16A, a straight zipper 33 may be fitted, coil down, into a curved fixture or template 70. A backing may be applied to the zipper, such as a resiliently flexible polymeric material, such as a thermoplastic polymer (e.g. polyurethane). The backing thus applied may provide a resiliently flexible curved conformation to the slide fastener. For example, the zipper in the template with a thermoplastic polymer backing may be subjected to heat and light pressure (such as 330° F. for 20 seconds) sufficient to attach the backing to the fastener, and then cooled rapidly (for example during a 10 second period) with light pressure being applied, to fix the backing to the fastener. In this way, a resiliently flexible polymeric backing may for example be applied to the tape portion of a zipper (the portion of the zipper attached to the interdigitating elements). The nature of the treatment will vary with the selected backing and fastener material. Following such a heat treatment, zipper 34 may be removed from the template, while retaining its curved configuration. As an additional aspect of the invention, the zipper is made water resistant by the polymeric backing. The use of a polymeric backing to provide water resistance in straight zippers is, however, known.

In an alternative aspect, the invention provides a windowed shoulder pocket 32 having a slide fastener 46 closure adjacent to window 52. Window 52 may be at least partly transparent so that the interior of the shoulder pocket is visible through the window. Shoulder pocket 32 may for example be shaped to receive a radio, having an elongated upper portion shaped to receive an antenna.

Although various embodiments of the invention are disclosed herein, many adaptations and modifications may be made within the scope of the invention in accordance with the common general knowledge of those skilled in this art. Such modifications include the substitution of known equivalents for any aspect of the invention in order to achieve the same result in substantially the same way. Numeric ranges are inclusive of the numbers defining the range. In the specification, the word "comprising" is used as an open-ended term, substantially equivalent to the phrase "including, but not limited to", and the word "comprises" has a corresponding meaning. Citation of references herein shall not be construed as an admission that such references are prior art to the present invention. All publications, including but not limited to patents and patent applications, cited in this specification are incorporated herein by reference as if each individual publication were specifically and individually indicated to be incorporated by reference herein and as though fully set forth herein. The invention includes all embodiments and variations substantially as hereinbefore described and with reference to the examples and drawings.

What is claimed is:

1. A hood having a head covering and a face opening, the hood comprising an adjustable drawstring arrangement providing for simultaneous circumferential tensioning of the head covering to secure the hood to a wearer's head and vertical temporal tensioning of the face opening, wherein the drawstring arrangement comprises one or more cranial cord segments encircling the head covering and connected to a top portion of left and right temporal cord segments on each lateral side of the face opening, so that:

(a) manual tensioning of the cranial cord segment acts to secure the hood to a wearer's head and to tension the temporal cord segments; or, (b) manual tensioning of either the left or right temporal cord segment acts to tension a cranial cord segment to secure the hood to a wearer's head.

2. The hood of claim 1 wherein the cranial cord segments are generally horizontal and temporal cord segments are generally vertical.

3. The hood of claim 1 wherein the wherein at least one of the cord segments is elasticated.

4. The hood of claim 1 wherein the hood comprises a material and the drawstring runs in a channel formed in the material.

5. The hood of claim 1 wherein the hood further comprises a brim, and the brim comprises an inner cranial cord segment flexibly connected to an outer brim reinforcing member.

6. A jacket comprising the hood of claim 1.

* * * * *